US005178169A

United States Patent [19]

Lamle

[11] Patent Number: 5,178,169

[45] Date of Patent: Jan. 12, 1993

[54] DEVICE AND METHOD FOR SELECTING COSMETICS

[76] Inventor: Stewart Lamle, 3 Fordham Hill Oval, Suite 15F, Bronx, N.Y. 10468

[21] Appl. No.: 803,593

[22] Filed: Dec. 9, 1991

[51] Int. Cl.[5] ..... A45D 40/00

[52] U.S. Cl. ..... 132/319; 116/200; 434/100

[58] Field of Search ..... 116/200, DIG. 4; 132/319, 320, 333, 294; D28/4, 7; 434/99, 100

[56] References Cited

U.S. PATENT DOCUMENTS

| | | | |
|---|---|---|---|
| 1,741,080 | 12/1929 | Stenz | 434/100 |
| 2,088,076 | 7/1937 | Winslow | 132/333 |
| 2,623,304 | 12/1952 | Watson | 434/100 |
| 3,598,685 | 8/1971 | Lee et al. | 132/320 X |
| 3,851,655 | 12/1974 | Tarro | 132/294 |
| 4,909,632 | 3/1990 | McFarlane | 434/99 X |

FOREIGN PATENT DOCUMENTS

| | | | |
|---|---|---|---|
| 1011743 | 3/1949 | France | 132/319 |
| 1110340 | 2/1956 | France | 132/319 |
| 584980 | 11/1958 | Italy | 132/319 |

*Primary Examiner*—Daniel M. Yasich
*Attorney, Agent, or Firm*—Robert W. J. Usher

[57] ABSTRACT

A cosmetics selecting device comprising a flexible strip having major face divided longitudinally into a series of comparison zones, each zone being marked in at least one of the different color, shade and tone of cosmetic product from an adjacent zone and a corresponding cosmetic identifying indicia, opposite ends of the strip having respective finger-pieces such that the strip can be manually flexed against the skin to bring a plurality of adjacent zones into juxtaposition therewith for precise comparison purposes. The indicia may be mirror images of letters or numerals enabling instant recognition of a mirror reflection. The finger-piece portion is not marked by cosmetic product to avoid soiling a user's hand.

7 Claims, 1 Drawing Sheet

DEVICE AND METHOD FOR SELECTING COSMETICS

FIELD OF THE INVENTION

The invention relates to a device and method for selecting cosmetics.

BACKGROUND OF THE INVENTION

The inherent difficulties of an unassisted individual herself selecting the correct cosmetic to match her skin both in color, shade and tone or sheen is well recognized.

U.S. Pat. No. 3,851,655 to Tarro, issued Dec. 3, 1974 teaches one approach to cosmetics selection which rejects printed color charts and directs the user to a comparison between a useable supply of the actual product packaged in a transparent covering layer and either, a reflected image of the user's skin or, directly with the skin itself. However, a range of products is therefore required for selection which can often, therefore, be carried out only in the store itself while several of products cannot be conveniently held together against the skin for simultaneous comparison. Handling actual cosmetic product is also relatively time consuming while the covering of the product by a transparent film alters the reflectivity or sheen perceived for comparison.

Furthermore, the comparison of a user's reflected image with a product is also insufficiently accurate for precise matching purposes.

SUMMARY OF THE INVENTION

It is an object of the invention to enable selection of a cosmetic by a user, unassisted by another, while avoiding the need for comparison to be made with a range of actual cosmetic product.

It is a further object to provide a convenient solution at a minimum cost both to the user and to the cosmetic vendor.

According to the invention there is provided a cosmetics selecting device comprising a elongate flexible strip having a major face divided longitudinally into a series of comparison zones, each zone being marked in at least one of a different color, shade and tone of cosmetic product from an adjacent zone and with a correspondingly different cosmetic identifying indicia, opposite ends of the strip having respective finger-pieces by which the strip can be manually flexed against the skin by engaging such portions to bring a plurality of adjacent zones into juxtaposition with the skin for precise comparison purposes.

The user can simply hold the strip adjacent the skin of the forehead, for example, while moving the strip longitudinally to a location of approximate match then press the strip against the skin at that location, flexing the strip into conformity with the skin contour to enable a precise match to be obtained.

The marking may be made by the product itself or by a conventional printing process.

Preferably, the indicia comprise mirror images of one of letters or numerals, enabling instant recognition by the user.

Desirably, a finger-piece does not carry the color of a cosmetic product thereby avoiding risk of confusion and of staining the user's fingers.

BRIEF INTRODUCTION TO THE DRAWINGS

A specific embodiment of a cosmetic selecting device according to the invention will now be described with reference to the accompanying drawings in which.

Figure 1:
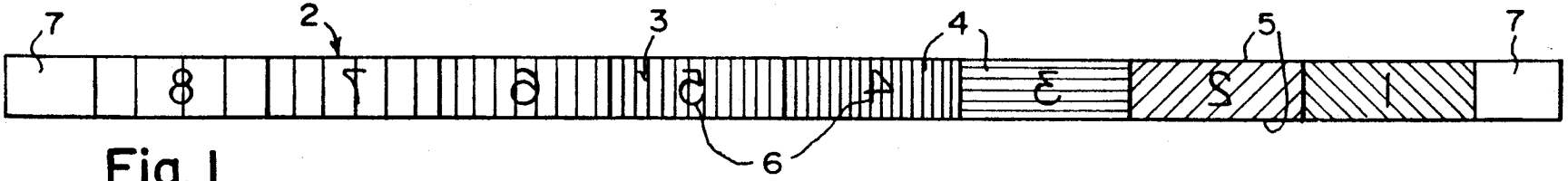
FIG. 1 is a plan view of the device.
Figure 2:
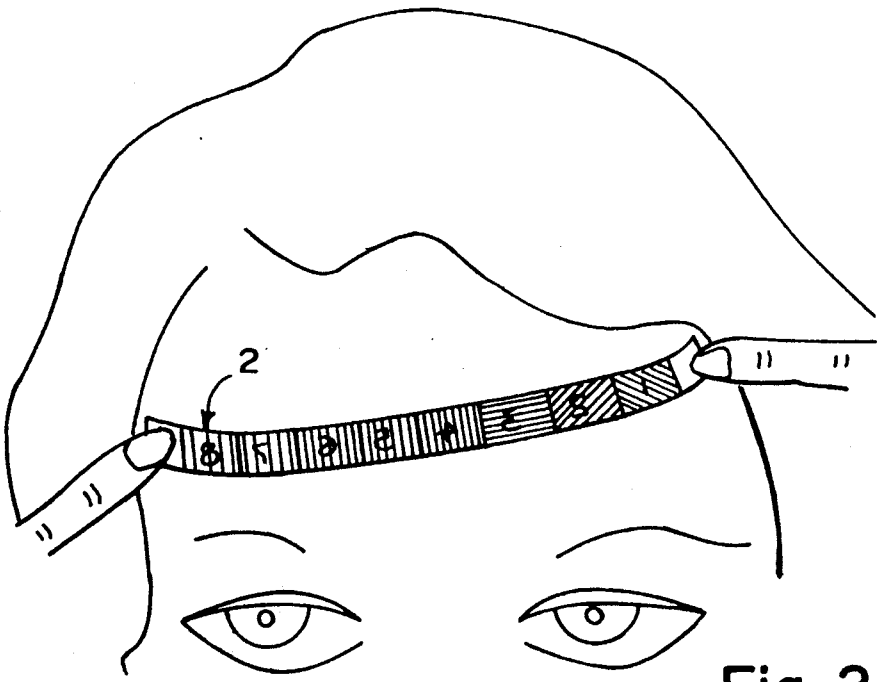
FIG. 2 is a front view showing the application of the device to a forehead of a user.

As shown, an integrally formed imperforate, strip 2 of flexible cardboard (or plastic) material has a major face 3 divided longitudinally into a series of comparison zones 4, each being marked with a different color, shade or tone of cosmetic product from an adjacent zone and extending completely to the opposite longitudinal edges 5 of the strip to enable a complete juxtaposition with the skin, unbroken by a border.

Each zone 4 is marked with a mirror image of a number 6 identifying the cosmetic corresponding to that zone. Finger-pieces are formed at opposite ends of the strip (only one shown) one of which is not colored (e.g. white) to avoid soiling the user's fingers. An identical finger-piece may be formed at the opposite end of the strip.

In use, the finger-piece 7 is grasped by the user and the strip moved longitudinally along the skin, while viewing both strip and skin in a mirror, to a position in which an approximate match of skin and strip zones is obtained. The strip is then pressed into conformity with the contour of the skin so as to be substantially coplanar therewith by the user's fingers engaging opposite ends thereof to obtain a precise match of the skin with deformation of the strip for example, into an arcuate shape when pressed against the forehead.

This enables a corresponding cosmetic to be identified quickly and accurately while variations in shade or tone of adjacent areas of skin can also be compared and matched as desired.

The cost of the device is clearly so very small such that the device may be distributed free of charge as a flyer in a fashion magazine for example or made freely available at cosmetic counters.

I claim:

1. A cosmetics selecting device comprising an elongate, imperforate flexible strip having a major face divided longitudinally into a series of adjoining comparison zones, each zone being completely marked in at least one of a different color, shade and tone of cosmetic product from an adjacent zone and extending to the longitudinal edges of the strip and with a correspondingly different cosmetic identifying indicia, opposite ends of the strip having respective finger-pieces by which the strip can be manually flexed against a user's skin by engaging such portions to bring a plurality of adjacent said zones into juxtaposition with the skin for precise comparison matching purposes.

2. A cosmetics selecting device according to claim 1 in which the indicia comprise mirror images of one of letters and numerals.

3. A cosmetics selecting device according to claim 2 in which a finger-piece is not marked with a cosmetic product.

4. A cosmetics selecting device according to claim 1 in which the marking is the cosmetic product itself.

5. A method of selecting a cosmetic precisely matching a user's skin surface by providing an elongate, imperforate flexible strip having a major face divided longitudinally into a series of adjoining comparison zones, each zone being completely marked in at least one of a different color, shade and tone of cosmetic product from an adjacent zone and extending to the longitudinal edges of the strip and with a correspondingly different cosmetic identifying indicia, opposite ends of the strip having respective finger-pieces, grasping a finger-piece and moving the strip longitudinally adjacent the skin surface to obtain an approximate comparison, flexing the strip against the skin surface to bring at least the approximately matching zones into juxtaposed, substantially coplanar relation with the skin surface to obtain a precise comparison and noting the indicia identifying the corresponding cosmetic product.

6. A method according to claim 5 including the step of viewing a mirror reflection of the zones and the skin during the comparison.

7. A method of selecting a cosmetic precisely matching a user's skin surface by providing an elongate, imperforate, flexible strip having a major face divided longitudinally into a series of adjoining comparison zones and at least one finger-piece at at least one end, completely marking respective zones with cosmetic products of at least one of a different color, shade and tone from an adjacent zone and extending to the longitudinal edges of the strip and with a correspondingly different cosmetic identifying indicia, grasping a finger-piece and moving the strip longitudinally adjacent the skin surface to obtain an approximate match between said zones and the skin surface, flexing the strip against the skin surface to bring at least the approximately matching zones into juxtaposed, substantially coplanar relation with the skin surface to obtain a precise match and noting the indicia identifying the corresponding cosmetic product.

* * * * *